US007366453B2

(12) United States Patent
Thompson et al.

(10) Patent No.: US 7,366,453 B2
(45) Date of Patent: Apr. 29, 2008

(54) XEROGRAPHIC DEVELOPER UNIT HAVING MULTIPLE MAGNETIC BRUSH ROLLS ROTATING AGAINST THE PHOTORECEPTOR

(75) Inventors: Michael D. Thompson, Rochester, NY (US); James M. Chappell, Webster, NY (US); Steven C. Hart, Webster, NY (US); Patrick J. Howe, Fairport, NY (US); Ajay Kumar, Fairport, NY (US); Steven R. Leroy, Hilton, NY (US); Paul W. Morehouse, Webster, NY (US); Palghat S. Ramesh, Pittsford, NY (US); Fei Xiao, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 305 days.

(21) Appl. No.: 11/262,575

(22) Filed: Oct. 31, 2005

(65) Prior Publication Data

US 2007/0098456 A1 May 3, 2007

(51) Int. Cl.
*G03G 15/09* (2006.01)

(52) U.S. Cl. ..... 399/269; 399/274; 399/276

(58) Field of Classification Search ..... 399/267, 399/269, 274, 276

See application file for complete search history.

(56) References Cited

U.S. PATENT DOCUMENTS 4,098,228 A 7/1978 Ruckdeschel et al.
4,384,545 A * 5/1983 Burnham et al. ..... 399/269
4,537,495 A 8/1985 Kopko
4,565,437 A * 1/1986 Lubinsky ..... 399/269
4,811,046 A 3/1989 May
5,153,376 A * 10/1992 Tomita ..... 399/276
5,194,905 A 3/1993 Brewington
5,614,994 A * 3/1997 Kreiter ..... 399/269
5,630,201 A 5/1997 Suzuki et al.
5,995,790 A * 11/1999 Takeda ..... 399/274
6,473,586 B2 10/2002 Noda et al.
6,480,691 B2 * 11/2002 Okad ..... 399/276
7,218,881 B2 * 5/2007 Tanaka ..... 399/269

* cited by examiner

*Primary Examiner*—William J Royer
(74) *Attorney, Agent, or Firm*—Maginot, Moore & Beck

(57) ABSTRACT

A development subsystem is used to develop developer having semiconductive carrier particles and toner particles. The development subsystem includes a developer housing, for retaining a quantity of developer having semiconductive carrier particles and toner particles, a first magnetic roll having a stationary core with at least one magnet and a sleeve that rotates about the stationary core of the first magnetic roll, a second magnetic roll having a stationary core with at least one magnet and a sleeve that rotates about the stationary core of the second magnetic roll, and a motor coupled to the first and the second magnetic rolls to drive the rotating sleeves of the first and the second magnetic rolls in a direction that is against the direction of a photoreceptor that rotates in proximity to the first and the second magnetic rolls. The first and the second magnetic rolls carry semiconductive carrier particles and toner particles through a development zone formed by the first and the second magnetic rolls.

18 Claims, 4 Drawing Sheets

XEROGRAPHIC DEVELOPER UNIT HAVING MULTIPLE MAGNETIC BRUSH ROLLS ROTATING AGAINST THE PHOTORECEPTOR

TECHNICAL FIELD

The present disclosure relates generally to an electrostatographic or xerographic printing machine, and more particularly concerns a development subsystem that uses semiconductive developer on a photoreceptor.

BACKGROUND

In the process of electrophotographic printing, a charge-retentive surface, also known as a photoreceptor, is charged to a substantially uniform potential, so as to sensitize the surface of the photoreceptor. The charged portion of the photoreceptor is exposed to a light image of an original document being reproduced, or else a scanned laser image created by the action of digital image data acting on a laser source. The scanning or exposing step records an electrostatic latent image on the photoreceptor corresponding to the informational areas in the document to be printed or copied. After the electrostatic latent image is recorded on the photoreceptor, the electrostatic latent image is developed by causing toner particles to adhere electrostatically to the charged areas forming the electrostatic latent image. This developed toner image on the photoreceptor is subsequently transferred to a sheet on which the desired image is to be printed. Finally, the toner on the sheet is heated to permanently fuse the toner image to the sheet.

One familiar type of development of an electrostatic latent image is called "two-component development". Two-component developer material largely comprises toner particles interspersed with carrier particles. The carrier particles are magnetically attractable, and the toner particles are caused to adhere triboelectrically to the carrier particles. This two-component developer can be conveyed, by means such as a "magnetic roll," to the electrostatic latent image, where toner particles become detached from the carrier particles and adhere to the electrostatic latent image.

In magnetic roll development systems, the carrier particles with the triboelectrically adhered toner particles are transported by the magnetic rolls through a development zone. The development zone is the area between the outside surface of a magnetic roll and the photoreceptor on which an electrostatic latent image has been formed. Because the carrier particles are attracted to the magnetic roll, some of the toner particles are interposed between a carrier particle and the electrostatic latent image on the photoreceptor. These toner particles are attracted to the electrostatic latent image and transfer from the carrier particles to the electrostatic latent image. The carrier particles are removed from the development zone as they continue to follow the rotating surface of the magnetic roll. The carrier particles then fall from the magnetic roll and return to the developer supply where they attract more toner particles and are reused in the development process. The carrier particles fall from the magnetic roll under the effects of gravity or are directed away from the roller surface by a magnetic field.

Different types of carrier particles have been used in efforts to improve the development of toner from two-component developer with magnetic roll development systems. One type of carrier particle is a very electrically insulated carrier and development systems using developer having these carrier particles typically develop lines and fine detail with high fidelity. Development efficiency for solid areas, however, is increased through low magnetic field agitation in the development zone along with close spacing to the electrostatic latent image and elongation of the development zone. The magnetic field agitation helps prevent electric field collapse caused by toner countercharge in the development zone. The close spacing increases the effective electric field for a potential difference and the longer development zone provides more time for toner development. A disadvantage of this type of development system is the tendency for the carrier beads to retain countercharge left by toner particles that were developed from the brush. Retention of the countercharge causes carrier beads to be lost to the photoreceptor background areas. This loss is undesirable and leads to contamination problems in the xerographic system as well as depletion of the developer sump over time. Other two-component developers have used permanently magnetized carrier particles because these carrier particles dissipate toner countercharge more quickly by enabling a very dynamic mixing region to form on the magnetic roll.

Another type of carrier particle used in two-component developers is an electrically conductive carrier particle. Developers using this type of carrier particle are capable of being used in magnetic roll systems that produce toner bearing substrates at speeds of up to approximately 100 pages per minute (ppm). These developers typically recruit toner for the electrostatic latent image from areas near the tip of the developer magnetic brush that are proximate the surface of the photoreceptor because the electric fields are high in this region. The electrical conductivity of the carrier particles serves to prevent development field collapse caused by the retention of toner countercharge and thereby allows high efficiency development, especially of solid area latent images. This type of developer, however, supplies an adequate amount of toner for high speed xerography with difficulty because the only toner available for development is the toner near the tip of the magnetic brush. Consequently, high development roller speeds are required. Unfortunately, high roller speeds increase the wear on the rollers and decrease the life of the rollers. Another problem that occurs with this type of developer is the tendency of the carrier particles, when the toner concentrations are low, to charge up in the image electric field. This charge causes the carrier particles to develop onto the image areas of the photoreceptor and leads to white spot deletions in the final image as well as carrier bead contamination in the system.

Another type of carrier particle used in two-component developers is the semiconductive carrier particle. Developers using this type of carrier particle are also capable of being used in magnetic roll systems that produce toner bearing substrates at speeds of up to approximately 100 pages per minute (ppm). Developers having semiconductive carrier particles use a relatively thin layer of developer on the magnetic roll in the development zone. This feature allows more of the toner to be recruited during development than thick brush conductive developers allow. In these systems an AC electric waveform is applied to the magnetic roller to cause the developer to become electrically conductive during the development process. The electrically conductive developer increases the efficiency of development by preventing development field collapse due to countercharge left in the magnetic brush by the developed toner. A typical waveform applied to these systems is, for example, a square wave at a peak to peak amplitude of 1000 Volts and a frequency of 9 KHz. This waveform controls both the toner movement and the electric fields in the development zone.

Typically these systems run in a "with" mode, which means the magnetic roll surface runs in the same direction as the photoreceptor. This movement in the same direction tends to keep background development low, but it has been observed to produce inadequate development unless high magnetic roll surface speeds are used to get an adequate supply of toner into the development zone. This high magnetic roll surface speed requires high strength magnets to control the developer bed. These types of magnets are expensive. Additionally, high speeds also increase the wear on bearings in the developer housing.

Another limitation of known magnetic roll systems used with developers having semiconductive carrier particles is the difficulty in extending the development zone to increase the time in which toner development may occur. One method for increasing development zone length with other developers having insulated or conductive carrier particles is to use two magnetic rolls. The two rolls are placed close together with their centers aligned to form a line that is parallel to the photoreceptor. Because the developer layer for semiconductive carrier particle developer is so thin, magnetic fields sufficiently strong enough to cause semiconductive carrier particles to migrate in adequate quantities from one magnetic roll to the other magnetic roll also interfere with the transfer of toner from the carrier particles in the development zones. Consequently, construction of the magnetic rolls requires careful consideration of this interference. If two rolls are not able to be used to increase the development zone, then the radius of the magnetic roll may be increased to accommodate this goal. There is a limit, however, to the diameter of the magnetic roll. One limit is simply the area within the printing machine that is available for a development subsystem. Another limit is the size and strength of the magnets internal to the magnetic roll that are required to provide adequate magnetic field strengths and shapes at the surface of a larger magnetic roll. Another problem with semiconductive development systems is a defect in which the system has trouble developing a halftone adjacent and following a solid so a halo of the solid is left at the boundary of the halftone. This happens at high toner concentrations and limits the latitude of the system.

The systems and methods discussed below address the limitations of development subsystems using developer having semiconductive carrier particles that have been noted.

SUMMARY

A development subsystem is used to develop toner having semiconductive carrier particles and toner particles. The development subsystem increases the time for developing the toner and provides an adequate supply of developer for good line detail, edges, and solids. The subsystem includes a developer housing, for retaining a quantity of developer having semiconductive carrier particles and toner particles, a first magnetic roll having a stationary core with at least one magnet and a sleeve that rotates about the stationary core of the first magnetic roll, a second magnetic roll having a stationary core with at least one magnet and a sleeve that rotates about the stationary core of the second magnetic roll, and a motor coupled to the first and the second magnetic rolls to drive the rotating sleeves of the first and the second magnetic rolls in a direction that is against the direction of a photoreceptor that rotates in proximity to the first and the second magnetic rolls. The first and the second magnetic rolls carry semiconductive carrier particles and toner particles through a development zone formed by the first and the second magnetic rolls.

A method for developing developer having semiconductive carrier particles in an electrostatographic printing machine includes retaining a quantity of developer having semiconductive carrier particles and toner particles, transporting the developer through a development zone for development on a photoreceptor in a direction that is against the direction of the photoreceptor rotating through the development zone. The transportation of the developer in this method may be implemented by rotating a first sleeve about a first stationary core having at least one magnet, rotating a second sleeve about a second stationary core having at least one magnet, and the rotation of the first and the second sleeves occurs in a direction that is against the direction of the photoreceptor.

DETAILED DESCRIPTION

Figure 1:
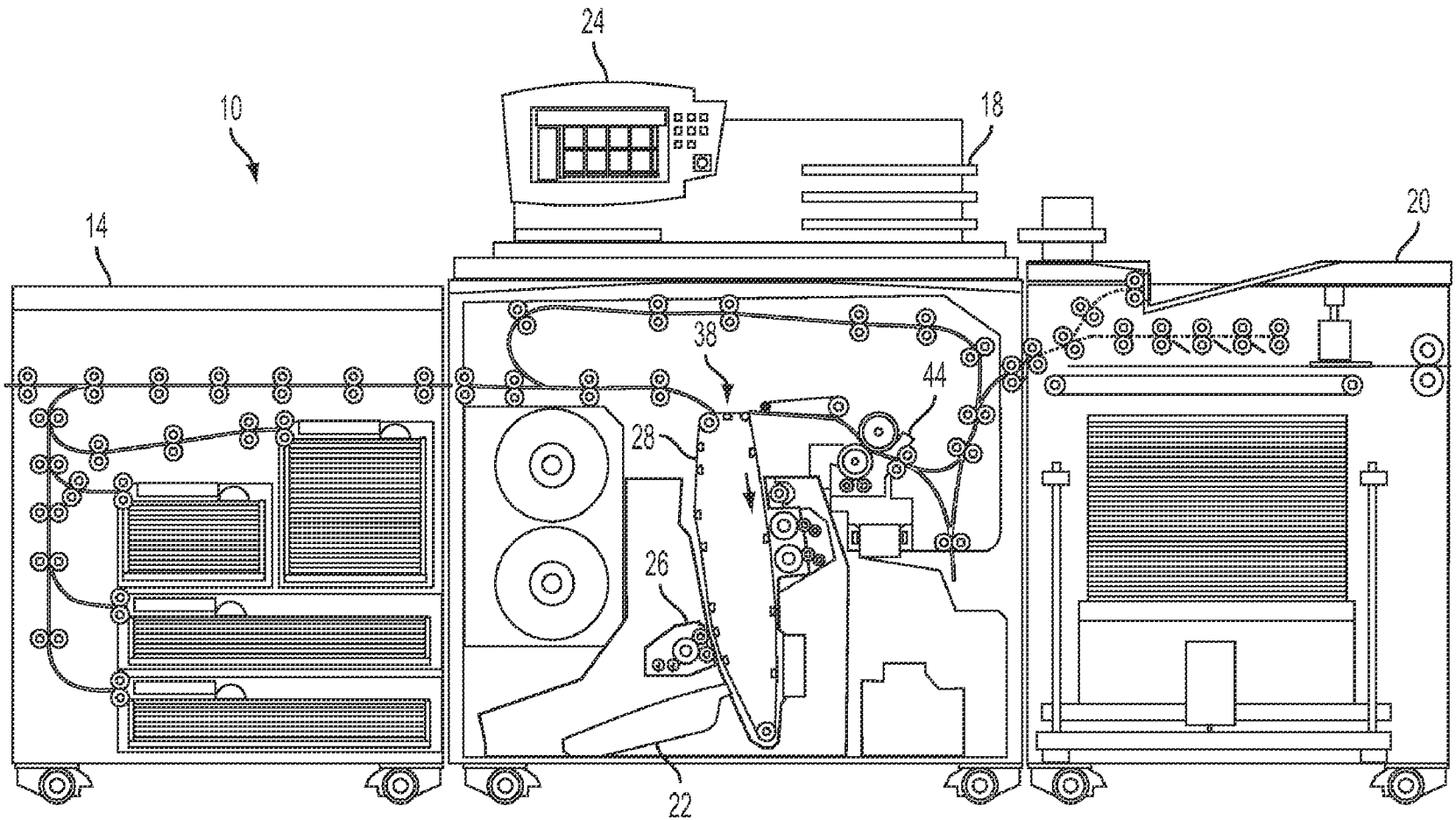
FIG. 1 is an elevational view of an electrostatographic printing apparatus incorporating a semiconductive magnetic brush development (SCMB) system having two magnetic rolls.

FIG. 1 is an elevational view of an electrostatographic printing apparatus 10, such as a printing machine, printer or copier, having a development subsystem that uses two magnetic rolls for developing toner particles that are carried on semiconductive carrier particles. The machine 10 includes a feeder unit 14, a printing unit 18, and an output unit 20. The feeder unit 14 houses supplies of media sheets and substrates onto which document images are transferred by the printing unit 18. Sheets to which images have been fixed are delivered to the output unit 20 for correlating and/or stacking in trays for pickup.

The printing unit 18 includes an operator console 24 where job tickets may be reviewed and/or modified for print jobs performed by the machine 10. The pages to be printed during a print job may be scanned by the machine 10 or received over an electrical communication link. The page images are used to generate bit data that are provided to a raster output scanner (ROS) 30 for forming a latent image on a photoreceptor 28. Photoreceptor 28 continuously travels the circuit depicted in the figure in the direction indicated by the arrow. A development subsystem 26 develops toner on the photoreceptor 28. At a transfer station 38, the toner conforming to the latent image is transferred to the substrate by electric fields generated by the transfer station 38. The substrate bearing the toner image travels to a fuser station 44 where the toner image is fixed to the substrate. The substrate is then carried to the output unit 20. This description is provided to generally describe the environment in which a double magnetic roll development system for developer having semiconductive carrier particles may be used and is not intended to limit the use of such a development subsystem 26 to this particular printing machine environment.

Figure 2:
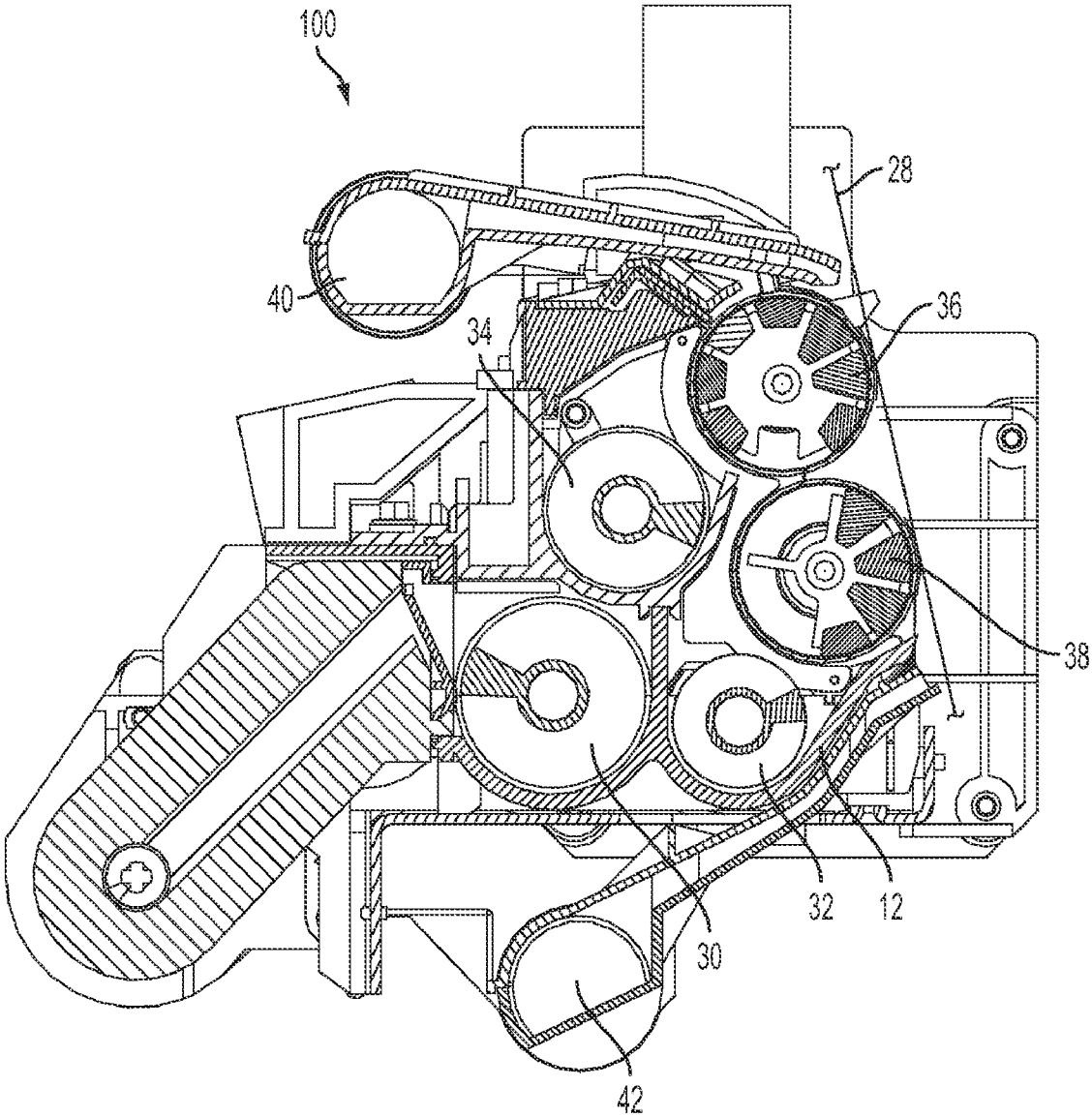
FIG. 2 is a sectional view of a SCMB developer unit having two magnetic rolls.

The overall function of a developer unit 100, which is shown in FIG. 2, is to apply marking material, such as toner, onto suitably-charged areas forming a latent image on an image receptor such as the photoreceptor 28, in a manner generally known in the art. The developer unit 100, however, provides a longer development zone while maintaining an adequate supply of developer having semiconductive carrier particles than development systems previously known. In various types of printers, there may be multiple such developer units 100, such as one for each primary color or other purpose.

Among the elements of the developer unit 100, which is shown in FIG. 2, are a housing 12, which functions generally to hold a supply of developer material having semiconductive carrier particles, as well as augers, such as 30, 32, 34, which variously mix and convey the developer material, and magnetic rolls 36, 38, which in this embodiment form magnetic brushes to apply developer material to the photoreceptor 28. Other types of features for development of latent images, such as donor rolls, paddles, scavengeless-development electrodes, commutators, etc., are known in the art and may be used in conjunction with various embodiments pursuant to the claims. In the illustrated embodiment, there is further provided air manifolds 40, 42, attached to vacuum sources (not shown) for removing dirt and excess particles from the transfer zone near photoreceptor 28. As mentioned above, a two-component developer material is comprised of toner and carrier. The carrier particles in a two-component developer are generally not applied to the photoreceptor 28, but rather remain circulating within the housing 12. The augers 30, 32, and 34 are configured and cooperate in a manner described in co-pending applications entitled "Variable Pitch Auger To Improve Pickup Latitude In Developer Housing," U.S. Ser. No. 11/263,370, which was filed on even date herewith, and "Developer Housing Design With Improved Sump Mass Variation Latitude," U.S. Ser. No. 11/263,371, which was also filed on even date herewith, both of which are hereby expressly incorporated herein in their entireties by reference and are commonly assigned to the assignee of this patent application.

Figure 3:
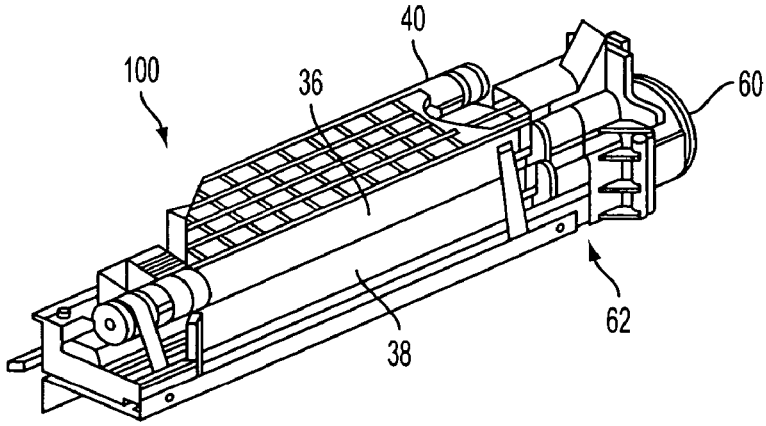
FIG. 3 is a perspective view of a SCMB developer unit having two magnetic rolls.

FIG. 3 is a perspective view of a portion of developer unit 100. As can be seen in this embodiment, the upper magnetic roll 36 and the lower magnetic roll 38 form a development zone that is approximately as long as the two diameters of the magnetic rolls 36 and 38. As further can be seen, a motor 60 is used with a mechanism, generally indicated with reference numeral 62, to cause rotation of the various augers 30, 32, 34, magnetic rolls 36 and 38, and any other rotatable members within the developer unit 100 at various relative velocities. There may be provided any number of such motors. The magnetic rolls 36 and 38 are rotated in a direction that is opposite to the direction in which the photoreceptor 28 moves past the developer unit 100. That is, the two magnetic rolls 36 and 38 are operated in the against mode for development of toner. In one embodiment of the developer unit 100, the motor 60 and the mechanism 62 cause the magnetic rolls 36 and 38 to rotate at a speed in the range of about 1 to about 1.5 times the rotational speed of the photoreceptor 28. This rotational speed is lower than the rotational speed of magnetic rolls in developer systems that rotate in the same direction as the photoreceptor 28. That is, the magnetic rolls operated in the against mode may be rotated at lower speeds than magnetic rolls operated in the with mode. These slower speeds increase the life of the magnetic rolls over the life of magnetic rolls that are operated in the with mode to develop toner carried on semiconductive carrier particles.

Figure 4:
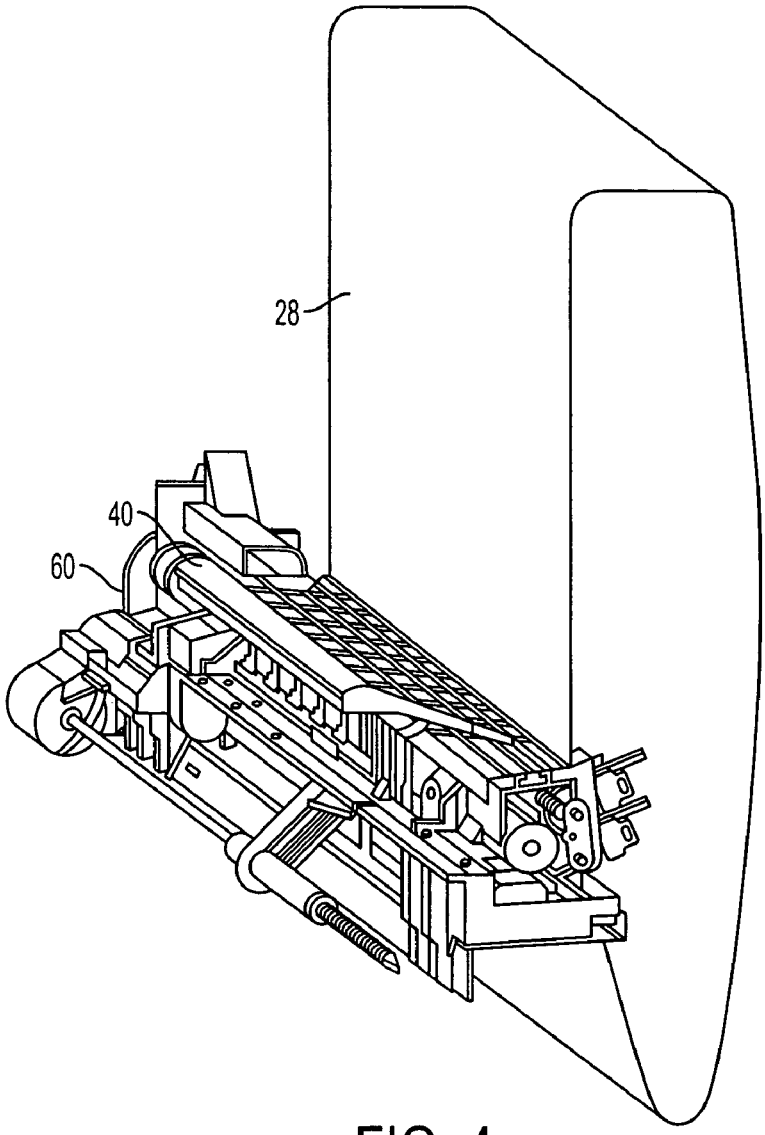
FIG. 4 is a perspective view of a SCMB developer unit showing the relationship of the two magnetic rolls to the path of the photoreceptor bearing a latent image.

FIG. 4 shows the relationship of the photoreceptor 28 to the developer unit 100 within a printing machine, such as the machine 10 shown in FIG. 1. In this arrangement, the lower magnetic roll 38 develops approximately 70% of the toner that is developed in the development zone of the developer unit 100 and the upper magnetic roll 36 develops approximately 30% of the toner. The upper magnetic roll 36 also cleans up the carrier particles from the development zone. The two magnetic roll arrangement operating in the against mode is able to develop toner carried by semiconductive carrier particles while maintaining fine line and edge development at speeds from 100 to over 200 ppm.

As is well known, magnetic rolls, such as magnetic rolls 36 and 38, are comprised of a rotating sleeve and a stationary core in which magnets are housed. In order to provide a surface that impedes the slippage of carrier particles as the outer sleeve rotates, the outer surface of the rotating sleeve may be sand-blasted or grooved. Previously known SCMB systems used sand-blasted stainless steel rollers, but these rollers have relatively short functional life of approximately 2 million prints or copies. Other known magnetic brush systems that use other types of developers used grooved stainless steel rollers having a depth of approximately 200 to 250 microns. The use of these grooved rollers in a double magnetic roller development subsystem operating in the against mode reduced the trim gap for the development subsystem from approximately 0.7 mm to approximately 0.135 mm. The trim gap is the distance between the trim blade and the upper magnetic roll 36. The trim blade assists in the removal of excess developer from the upper magnetic roll 36 before it is carried into the development zone.

A narrow trim gap presents issues with respect to the manufacturing of the developer unit. For one, the tolerances for the components that comprise the trim blade that assists in the removal of carrier particles from the upper magnetic roll are more difficult to meet. More precise manufacturing techniques and higher rejection rates increase the unit manufacturing cost for the trim blade. Additionally, a narrower trim gap requires greater torque from the motor driving the roller and it also increases the aging of the developer.

Figure 5:
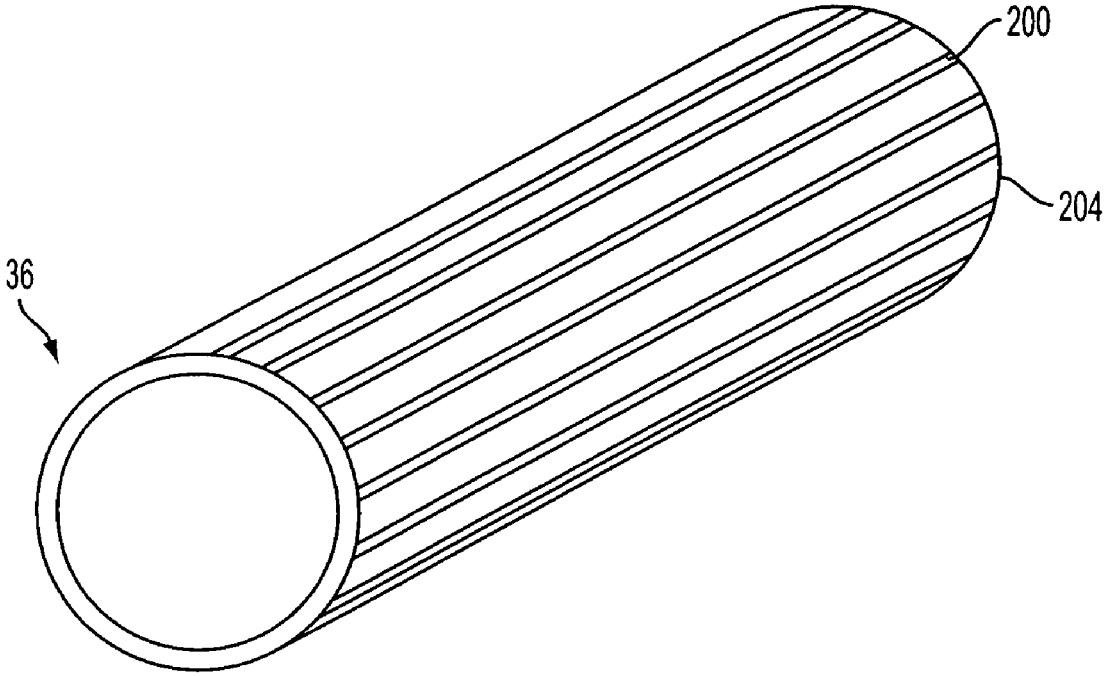
FIG. 5 is a perspective view of a magnetic roll used in the developer system shown in FIG. 2.

In an embodiment that uses stainless rollers to provide relatively long life for the rollers, for example, 20 million prints, the rollers are made of stainless steel that has been machined with longitudinal grooves that support a trim gap of approximately 0.5 mm to approximately 0.7 mm. To increase the trim gap to this distance, the rotating sleeves were machined with grooves as shown, for example, in FIG. 5. The grooves 200 are machined across the face of the rotating sleeve 204. The grooves 200 are approximately 1.2 mm to approximately 1.4 mm apart. The area between the grooves 200 may be sandblasted, however, surfaces that are relatively smooth between the grooves 200 support more acceptable trim gaps. In one embodiment, the surface roughness of sleeve 204 between the grooves is less than about 2.0 Rz. The grooves 200 assist in maintaining the semiconductive carrier particles on the magnetic rolls as they move through the development zone.

In one embodiment, the grooves 200 are preferably cut in either a U or a V shape, although other shapes may be used. The U or V-shaped grooves may be formed in one of two manners. In one construction, the sides of the U or the V-shaped grooves may have the same pitch, but the U-shaped grooves are deeper than the V-shaped grooves. In the other construction, the U and V-shaped grooves may have the same depth, but the U-shaped grooves have sides with a pitch that are shallower than the sides of the V-shaped grooves.

As shown in the figure, the sides of a groove 200 are oriented at an angle of approximately 90°±10° and pitched to be a length of about 1.2 to about 1.4 mm. The depth of a groove 200 is approximately 90 to 100 microns. These groove parameters may be used with a trim magnet having a pole strength of approximately 400 to 600 gauss. Of course, these parameters may be altered for other roll dimensions or trim magnet pole strengths. A pair of magnetic rolls having the grooves described above was capable of being long life stainless steel sleeves that operated with a trim gap of approximately 0.5 to 0.7 mm, instead of the 0.135 mm gap experienced with the magnetic rolls having rotating sleeves that had grooves of approximately 200 microns to 250 microns.

Although the various embodiments described above have been discussed with regard to an arrangement in which the developer is distributed from an upper magnetic roll to a lower magnetic roll, the reverse may also be used in another embodiment. In such an embodiment, the developer having semiconductive carrier particles is picked up by the lower magnetic roll and then transferred from the lower magnetic roll to the upper magnetic roll. At the upper magnetic roll, the semiconductive carrier particles are removed by gravity or the magnetic field generated by one or more magnets in the upper magnetic roll or a combination of gravity and magnetic fields. The removed carrier particles are returned to the developer supply.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A development subsystem for an electrostatographic printing machine, comprising:

a developer housing, for retaining a quantity of developer having semiconductive carrier particles and toner particles;

a first magnetic roll having a stationary core with at least one magnet and a sleeve that rotates about the stationary core of the first magnetic roll;

a second magnetic roll having a stationary core with at least one magnet and a sleeve that rotates about the stationary core of the second magnetic roll;

a motor coupled to the first and the second magnetic rolls to drive the sleeves of the first and the second magnetic rolls at a rotational speed that is in a range of about 1 to about 1.5 times a rotational speed of a photoreceptor that rotates in proximity to the first and the second magnetic rolls and in a direction that is against a direction of rotation for the photoreceptor, the first and the second magnetic rolls carrying semiconductive carrier particles and toner particles through a development zone formed by the first and the second magnetic rolls.

2. The subsystem of claim 1, the first magnetic roll being mounted above the second magnetic roll.

3. The subsystem of claim 2, wherein the motor drives the sleeves of the first magnetic roll and the second magnetic roll so that the semiconductive carrier particles are transferred downwardly through the development zone while the photoreceptor rotates upwardly through the development zone.

4. The subsystem of claim 2, wherein the motor drives the sleeves of the first magnetic roll and the second magnetic roll so that the semiconductive carrier particles are transferred upwardly through the development zone while the photoreceptor rotates downwardly through the development zone.

5. The subsystem of claim 1, further comprising:

a trim blade mounted proximate one of the first or the second magnetic rolls to form a trim gap of approximately 0.135 mm.

6. The subsystem of claim 1, the first and the second magnetic rolls further comprising:

longitudinal grooves in the rotating sleeves of the first and the second magnetic rolls.

7. The subsystem of claim 6 further comprising:

a trim blade mounted proximate one of the first or the second magnetic rolls to form a trim gap of approximately 0.5 to 0.7 mm.

8. A method for developing electrostatic latent images with developer having semiconductive carrier particles and toner particles in an electrostatographic printing machine, comprising:

retaining a quantity of developer having semiconductive carrier particles and toner particles;

rotating a first sleeve about a first stationary core having at least one magnet; and rotating a second sleeve about a second stationary core having at least one magnet, the first and the second sleeves being rotated at a speed that is in a range of about 1 to about 1.5 times a rotational speed of a photoreceptor proximate the first and the second sleeves and in a direction that is against a direction of rotation for the photoreceptor to transport the developer through a development zone for development on the photoreceptor in the direction that is against the direction of rotation for the photoreceptor rotating through the development zone.

9. The method of claim 8, further comprising:

mounting the first sleeve above the second sleeve.

10. The method of claim 8, the developer transportation including:

transferring the semiconductive carrier particles of the developer downwardly through the development zone while the photoreceptor rotates upwardly through the development zone.

11. The method of claim 8, the developer transportation including:

transferring the semiconductive carrier particles of the developer downwardly through the development zone while the photoreceptor rotates upwardly through the development zone.

12. The method of claim 8, further comprising:

mounting a trim blade proximate one of the first or the second sleeves to form a trim gap of approximately 0.135 mm.

13. The method of claim 8, further comprising:

mounting a trim blade proximate one of the first or the second sleeves to form a trim gap of approximately 0.5 to 0.7 mm.

14. A printing unit for an electrostatographic printing machine comprising:

a photoreceptor that continuously moves about a circuit;

a raster output scanner (ROS) that generates a latent image on a portion of the photoreceptor as it moves past the ROS;

a development subsystem for developing toner on the latent image;

a transfer station for transferring the developed toner to a substrate;

a fusing station for fixing the transferred toner to the substrate; and the development subsystem further comprising:

a developer housing, for retaining a quantity of developer having semiconductive carrier particles and toner particles;

a first magnetic roll having a stationary core with at least one magnet and a sleeve that rotates about the stationary core of the first magnetic roll;

a second magnetic roll having a stationary core with at least one magnet and a sleeve that rotates about the stationary core of the second magnetic roll;

a motor coupled to the first and the second magnetic rolls to drive the sleeves of the first and the second magnetic rolls at a rotational speed that is in a range of about 1 to about 1.5 times a rotational speed of the photoreceptor and in a direction that is against a direction of rotation for the photoreceptor, the first and the second magnetic rolls carrying semiconductive carrier particles and toner particles through a development zone formed by the first and the second magnetic rolls.

15. The subsystem of claim 14, the first magnetic roll being mounted above the second magnetic roll.

16. The subsystem of claim 15, wherein the motor drives the rotating sleeves of the first magnetic roll and the second magnetic roll so that the semiconductive carrier particles are transferred downwardly through the development zone while the photoreceptor rotates upwardly through the development zone.

17. A development subsystem for an electrostatographic printing machine, comprising:

a developer housing, for retaining a quantity of developer having semiconductive carrier particles and toner particles;

a first magnetic roll having a stationary core with at least one magnet and a sleeve that rotates about the stationary core of the first magnetic roll;

a second magnetic roll having a stationary core with at least one magnet and a sleeve that rotates about the stationary core of the second magnetic roll;

a motor coupled to the first and the second magnetic rolls to drive the sleeves of the first and the second magnetic rolls in a direction that is against a direction of rotation for the photoreceptor that rotates in proximity to the first and the second magnetic rolls, the first and the second magnetic rolls carrying semiconductive carrier particles and toner particles through a development zone formed by the first and the second magnetic rolls; and a trim blade mounted proximate one of the first or the second magnetic rolls to form a trim gap of approximately 0.135 mm.

18. A development subsystem for an electrostatographic printing machine, comprising:

a developer housing, for retaining a quantity of developer having semiconductive carrier particles and toner particles;

a first magnetic roll having a stationary core with at least one magnet and a sleeve that rotates about the stationary core of the first magnetic roll;

a second magnetic roll having a stationary core with at least one magnet and a sleeve that rotates about the stationary core of the second magnetic roll;

a motor coupled to the first and the second magnetic rolls to drive the sleeves of the first and the second magnetic rolls in a direction that is against a direction of rotation for the photoreceptor that rotates in proximity to the first and the second magnetic rolls, the first and the second magnetic rolls carrying semiconductive carrier particles and toner particles through a development zone formed by the first and the second magnetic rolls; and a trim blade mounted proximate one of the first or the second magnetic rolls to form a trim gap of approximately 0.5 to 0.7 mm.

* * * * *